United States Patent [19]

Hysek

[11] Patent Number: 4,542,561

[45] Date of Patent: Sep. 24, 1985

[54] WRISTLET CLASP WITH UNFOLDING BUCKLE

[75] Inventor: Joerg-Manfred Hysek, Nyon, Switzerland

[73] Assignee: Jean Lassale S.A., Geneva, Switzerland

[21] Appl. No.: 573,951

[22] Filed: Jan. 26, 1984

[30] Foreign Application Priority Data

Jan. 28, 1983 [CH] Switzerland ..... 483/83

[51] Int. Cl.[4] ..... A44C 5/24

[52] U.S. Cl. ..... 24/71 R; 24/71 J; 24/71 ST; 24/265 WS

[58] Field of Search ..... 24/71 R, 71 A, 71 T, 24/71 TT, 71 J, 71 ST, 70 J, 265 WS

[56] References Cited

U.S. PATENT DOCUMENTS

| | | | |
|---|---|---|---|
| 2,262,623 | 11/1941 | Ritter | 24/71 J |
| 2,444,360 | 6/1948 | Mauch | 24/71 J |
| 2,461,309 | 2/1949 | Cedar | 24/71 J |
| 2,499,102 | 2/1950 | Levine | 24/71 J |
| 2,500,649 | 3/1950 | Szeglin | 24/71 J |
| 2,596,186 | 5/1952 | Volk | 24/71 J |
| 3,696,469 | 10/1972 | Kalinsky | 24/71 J |
| 3,699,616 | 10/1972 | Kalinsky | 24/71 J |
| 3,863,299 | 2/1975 | Hocq | 24/71 J |

FOREIGN PATENT DOCUMENTS

| | | | |
|---|---|---|---|
| 2442605 | 8/1980 | France | 24/71 J |
| 646071 | 11/1950 | United Kingdom | 24/71 SK |
| 739748 | 11/1955 | United Kingdom | 24/71 J |

*Primary Examiner*—Victor N. Sakran

*Attorney, Agent, or Firm*—Robert E. Burns; Emmanuel J. Lobato; Bruce L. Adams

[57] ABSTRACT

This wristlet clasp with unfolding buckle has a central portion made of two curved plates of which the relative position is adjustable and which can be secured by means of screws, the arms hingedly connected to the ends of this central portion being provided with side webs adapted to be secured by snap action to the widest element of the central portion of the clasp. The ends of the two arms to which the wristlet sections are attached and the gap possibly left between these ends in the closed clasp position are concealed by a cover plate adapted to be decorated.

4 Claims, 6 Drawing Figures

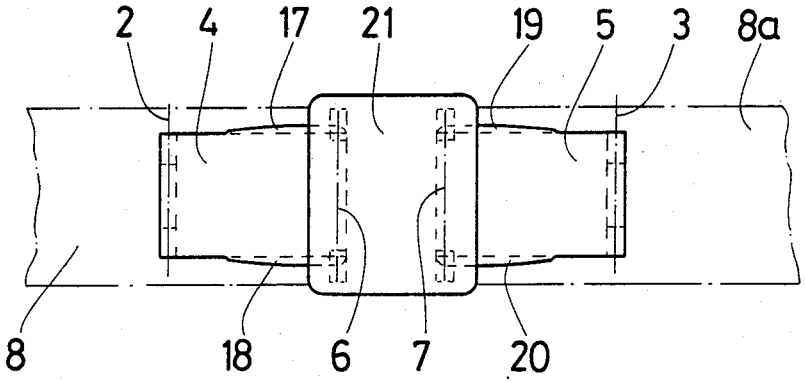
Fig. 1
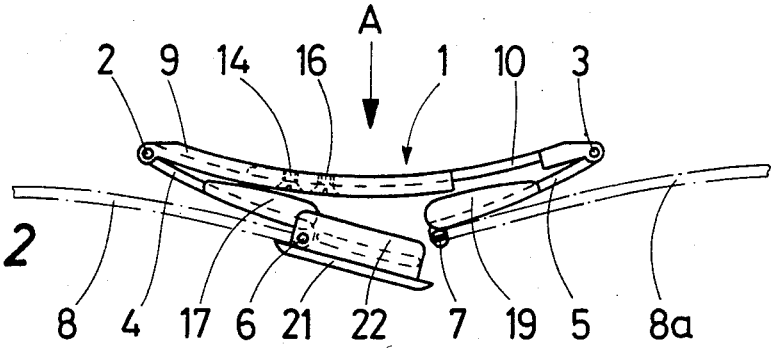
Fig. 2
Fig. 3
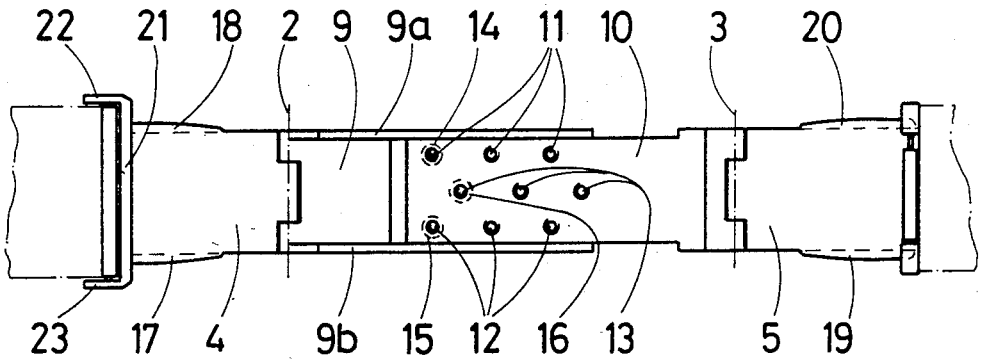

WRISTLET CLASP WITH UNFOLDING BUCKLE

The present invention relates to a wristlet clasp with unfolding buckle comprising a central portion having hingedly connected at its ends two opposite arms having the wristlet sections attached thereto by their ends, said arms being adapted to be folded on and fastened to the central portion in the closed clasp condition.

A clasp of this type is disclosed in the Swiss Pat. No. 596,793. In this clasp, the ends of the two hinged arms are snappily attached to a member provided centrally of the central portion. Another known system is disclosed in the Swiss Pat. No. 471,556. Clasps of this type are advantageous in that they are properly centered to the wristlet so that the latter, especially in the case of wrist watches, have a harmonious and balanced appearance. However, these clasps are objectionable in that they are not adjustable for the ends of the two hinged arms must meet in the middle of the central portion on the one hand for fastening them, and on the other hand for obvious reasons of aesthetics, notably for concealing this central portion.

It is the essential object of the present invention to provide a clasp of the type broadly set forth hereinabove which is adjustable lengthwise for properly adapting it to the wearer's wrist.

For this purpose, the wristlet clasp according to the present invention is characterized by the fact that the central portion consists of two members adapted to move longitudinally in each other, fastening means being provided for securing together the two members in the desired relative position and that at least one of said hinged arms comprises integral side plates whereby the arm concerned can engage notches formed in the side of the widest element of the central portion in the closed position, a cover plate being provided at the end fastened to the wristlet for covering the ends of the arms which are attached to the wristlet and, if necessary, bridging and concealing the gap left between these ends, in the closed position.

Due to the lateral fixing of the hinged arms to the central portion it is possible to secure said hinged arms at any desired location of the widest element of the central portion. The use of a cover plate provides a simple yet efficient solution of the problem arising from the gap developing between the ends of the hinged arms. Furthermore, this cover plate may carry various decorations, for example the pattern of a buckle, so that many different aspects can be given to the clasp.

In the drawings:

FIG. 1 is a plane view from above of a first form of embodiment of the clasp in its closed position;

FIG. 2 is a side elevational view of the same clasp shown in its half-open position;

FIG. 3 illustrates in plane view from above the same clasp in its open condition, as seen in the direction of the arrow A of FIG. 2;

Figure 4:
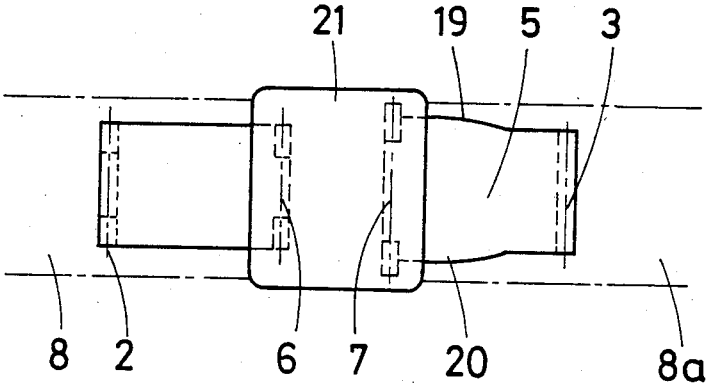
FIG. 4 is a plane view showing the clasp in its closed condition in the case of a second form of embodiment.

As in already known clasps of this character, the clasp illustrated in the attached drawings and more particularly in FIGS. 1–3 thereof comprises an arcuate central portion 1 having hingedly mounted at either ends 2 and 3 two opposite arms 4,5 adapted to be folded on this central portion 1. Secured to the ends 6 and 7 of arms 4 and 5 are the inner ends of the sections 8 and 8*a* respectively of a wristband, for example a leather wristlet.

The central portion 1 consists of a plate 9 having a U-shaped cross section receiving between its side webs or wings 9*a* and 9*b* a plate 10 having the same curvature as plate 9 and provided with three rows 11,12 and 13 of tapped holes engageable by three matching screws 14,15 and 16 embedded in plate 9 and thus retained by their heads in this plate. The purpose of these screws 14,15,16 is to impart a satisfactory rigidity to the assembly. However, a single screw would be sufficient. It is thus possible to adapt the length of the wristlet to the wearer's wrist by engaging and locking the screws 14,15 and 16 in the proper tapped holes of said rows 11,12 and 13, without impairing the symmetry of the wristlet, that is, the centered position of the clasp on the wristlet.

The fixing of the two arms 4 and 5 to the central portion 1 in the closed wristlet position is obtained through the snap action of two pairs of webs 17,18 and 19,20 respectively, which are thus caused to resiliently nip the side webs or wings 9*a* and 9*b* of plate 9.

In contrast to the known non-adjustable unfolding-buckle clasps in which the two ends of the hinged arms are pivotally connected to each other centrally of the clasp, in the present form of embodiment the relative spacing of the ends of these arms is variable as a function of the relative position of plates 9 and 10. The problem consisting in obtaining this variable relative spacing is solved according to the present invention by providing a cover plate 21 formed with a pair of side webs 22,23 adapted to snappily engage with a moderate resilient force the ends of the transverse pin 7 through which the wristlet section 8 is connected to the clasp, whereby this cover plate 21 is properly retained by an additional force on the wristlet. This cover plate 21 is particularly suited for displaying a decoration or receiving any other ornamental design, notably an element having the same appearance as the wristlet and imparting to the plate 21 the appearance of a light buckle. The wristlet may be secured to the clasp through any known and suitable means, notably a screw pin, a spring-loaded telescopic toggle, or the like.

The two jointed couplings of the clasp are preferably of the hinge-pin type.

To open the clasp it is only necessary to lift the cover plate 21 and then pull out the arm 5.

In a modified form of embodiment (not shown), the relative positioning of plates 9 and 10 of the clasp is obtained not by means of screws but by forming notches on the one hand inside the wings 9*a* and 9*b* and on the other hand on the sides of plate 10. The movement from one notch to another is obtained by overcoming the resilient force tending to keep the plates in their relative position, an additional resiliency being imparted to plate 10, if desired, by forming a longitudinal slot therein. Another solution would consist in forming notches only in the wings 9*a* and 9*b* and to fit a small rotary eccentric member in plate 10, this eccentric member being provided with teeth engageable in notches formed in the other plate 9. This plate 9 may have a tubular or a tubular and split configuration, the wings 9*a* and 9*b* comprising a perpendicular elbow directed inwardly of the clasp.

Figure 5:
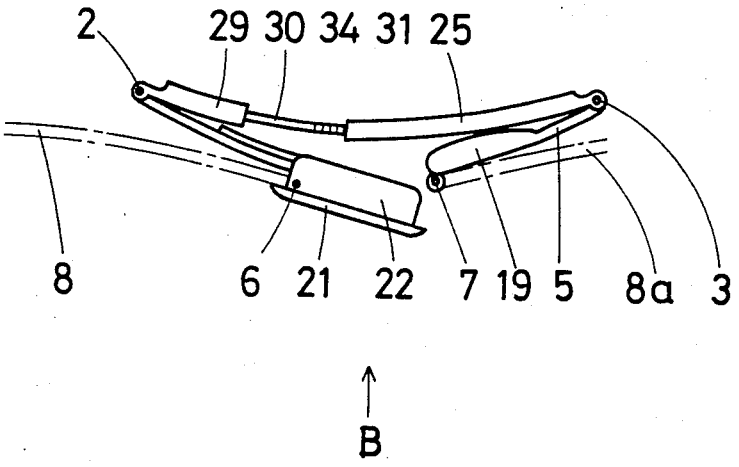
FIG. 5 is a side elevational view showing the same clasp in its partially open condition.
Figure 6:
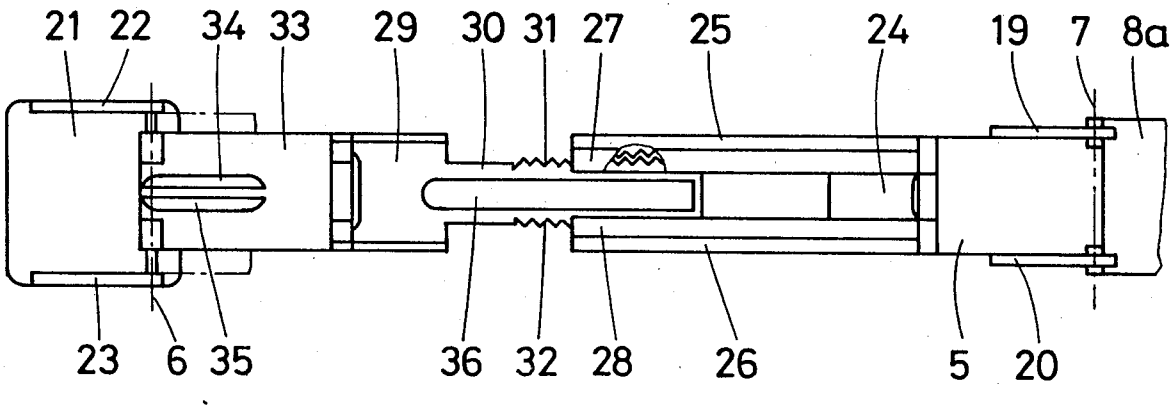
FIG. 6 is a view taken in the direction of the arrow B of FIG. 5, showing the same clasp in its fully open condition.

Another form of embodiment of the clasp of the present invention is illustrated in FIGS. 4, 5 and 6 of the drawings. The component elements incorporated without any modification in this modified form of embodiment are designated by the same reference numerals.

In this modified form of embodiment the central portion comprises a first section 24 having two parallel slightly curved rectangular arms 25 and 26 having a curvature corresponding to the desired wristlet curvature. The inner sides, facing each other, of said arms 25,26 constitute slideways 27 and 28 having their bottoms provided with triangular teeth or notches. The other section 29 comprise a single central arm 30 formed on either side with triangular teeth 31,32. This arm 30 engages the slideways 27 and 28 so that the teeth 31 and 32 engage the teeth or notches of said sideways 27 and 28. However, the teeth 31 and 32 can clear the teeth of slideways 27 and 28 by resiliently separating the arms 25 and 26 when a sufficient tractive effort or pressure is exerted on section 29 while retaining section 24. The arm 5 formed with side webs 19 and 20 is hingedly connected to this section 24 and another arm 33 is pivotally connected on the one hand to section 29 and on the other hand to cover plate 21. This arm 33 is provided with a pair of longitudinal central ribs 34 and 35 formed at its ends with a small outwardly projecting heel. Besides, section 29 comprises a longitudinal central notch 36 of a width slightly smaller than the maximum total width of the assembly of said two ribs 34 and 35.

To close the clasp, the wearer firstly folds the arm 5 on section 24. Thus, the function of webs 19 and 20 is not only to fix the arm 5 in the proper notches of section 24 but also to prevent the arms 25 and 26 from moving apart, i.e. preventing a movement of arm 30 with respect to arms 25 and 26. Then the arm 33 is folded on section 29. The ribs 34 and 35 yield slightly as they are forced into the notch 36 where they are snappily received. Finally, the cover plate 21 is again retained through its webs 22 and 23 by the pivot pin 7.

While the above description and the accompanying drawings refer to a specific form of embodiment of the present invention, it will readily occur to those conversant with the art that various changes and modifications may be brought thereto without departing from the basic principled of the invention.

What is claimed is:

1. A wristlet clasp for connecting the ends of a wristlet, said clasp comprising an elongate curved central portion comprising two plates adjustable lengthwise relative to one another to vary the length of said central portion between maximum and minimum lengths, means for securing said two plates to one another in selected lengthwise position relative to one another, two curved arms hingedly connected to opposite ends respectively of said central portion, said arms having a combined length less than the minimum length of said central portion and being swingable between an open position in which they extend beyond the ends of said central portion and a closed position in which they overlie the outer convex side of said central position, said arms have side webs engageable with side edges of said central portion with a snap engagement to retain said arms releasably in closed position, pivot means hingedly connecting ends of said wristlet with free ends of said arms respectively, and a cover plate hingedly connected with the free end of one of said arms for movement betwen an open position and a closed position in which it overlies and thereby covers a gap between the free ends of said arms when in closed position, said cover plate having a length sufficient to cover said gap when said central portion is of maximum length, and having side webs engageable with the hinge connection at the free end of the other arm with a snap engagement to retain said cover plate releasably in closed position.

2. A wristlet clasp according to claim 1, in which said arms are of equal length.

3. A wristlet clasp according to claim 1, in which one of said plates of said central portion is of U-shaped cross sections with side webs between which the other plate of said central portion is received, and in which said means for securing said plates is adjustable lengthwise relative to one another comprises at least one screw passing through a hole in one plate and screwed into a tapped hole in the other plate.

4. A wristlet clasp according to claim 1, in which said means for hingedly connecting ends of said wristlet with free ends of said arms respectively comprise pivot pins and in which said side webs of said cover plate are engageable with a snap engagement with the ends of said pivot pin connecting said wristlet with the free end of said other arm.

* * * * *